US011661266B2

(12) United States Patent
Buogo et al.

(10) Patent No.: US 11,661,266 B2
(45) Date of Patent: May 30, 2023

(54) DISPENSER

(71) Applicant: Reckitt & Colman (Overseas) Hygiene Home Limited, Slough (GB)

(72) Inventors: Alberto Buogo, Hull (GB); Guillaume Kensicher, Hull (GB); Christopher Brian Witty, Hull (GB); David Sanders, Warwick (GB)

(73) Assignee: RECKITT & COLMAN (OVERSEAS) HYGIENE HOME LIMITED, Slough (GB)

( * ) Notice: Subject to any disclaimer, the term of this patent is extended or adjusted under 35 U.S.C. 154(b) by 0 days.

(21) Appl. No.: 17/244,361

(22) Filed: Apr. 29, 2021

(65) Prior Publication Data

US 2022/0348398 A1 Nov. 3, 2022

(51) Int. Cl.
*B65D 83/38* (2006.01)
*B65D 83/28* (2006.01)

(52) U.S. Cl.
CPC ..... *B65D 83/384* (2013.01); *B65D 83/28* (2013.01)

(58) Field of Classification Search
CPC .... B65D 83/384; B65D 83/28; B65D 83/262; B65D 2583/005; B05B 11/00; B05B 11/0005; B05B 11/30; B05B 11/3001; B05B 11/3011; B05B 11/3012; B05B 11/3014; B05B 11/3045; B05B 11/3047; B05B 11/3002; B05B 11/3009; B05B 11/3056; B05B 11/3057; B05B 11/0054; A47K 5/12; B67D 1/0078
See application file for complete search history.

(56) References Cited

U.S. PATENT DOCUMENTS 4,345,627 A * 8/1982 Cassia ..... A47K 5/1208 222/325
5,449,117 A * 9/1995 Muderlak ..... A47K 17/00 222/646
9,205,167 B2 * 12/2015 Green ..... B05B 11/0054
2005/0205608 A1 * 9/2005 Ophardt ..... A47K 5/1207 222/181.3
2007/0102456 A1 * 5/2007 Tsay ..... B05B 11/3052 222/321.8
2009/0159614 A1 * 6/2009 Yacko ..... B65D 21/0237 222/129

FOREIGN PATENT DOCUMENTS

DE 2750936 B * 3/1979 ..... A47K 5/1205
GB 2168958 A * 7/1986 ..... B65D 47/06

* cited by examiner

*Primary Examiner* — Donnell A Long
(74) *Attorney, Agent, or Firm* — Norris McLaughlin PA

(57) ABSTRACT

Disclosed is a refill bottle configured to be insertable into a liquid fragrance dispensing device. The bottle includes a body and a neck, the body having an asymmetrical bulbous portion, which is configured such that a greater proportion of the liquid can be stored in the bottom half of the body than in the top half of the body of the refill bottle. Such results in that the centre of mass of the bottle is offset from the neck. The refill bottle may also include a rotatable spray head with a nozzle for dispensing a liquid fragrance contained within the bottle.

13 Claims, 3 Drawing Sheets

DISPENSER

The environmental benefit of using non-aerosol dispensers as a source of fluid has led to development in spraying fragrances and other fluids via devices from a non-aerosol fluid refill.

In general, devices for spraying fragrances, deodorising agents and sanitising fluids into a room generally consist of a device containing a removable source of fluid. In many devices, the source of fluid is an aerosol-based fluid that disperses a large distance upon activation. Spraying non-aerosol liquids requires a greater force to be used for activation because the force is directly related to the distance the liquid is projected.

The present invention relates to a device for spraying a fluid and particularly, but not exclusively to a device for spraying fluids such as fragrances, deodorizing fluids and/or a pest control material or the like in a non-aerosol form. The present invention also relates to a method of using such a device.

In a first aspect of the invention, there is a refill bottle for a liquid fragrance dispensing device. The bottle is configured to be inserted into the fragrance dispenser; wherein the bottle comprises a body and neck and the body comprises an asymmetrical bulbous portion; wherein the asymmetrical bulbous portion is located so that a greater proportion of the liquid can be stored in the bottom half of the body than the top half of the body wherein the asymmetrical bulbous portion results in the centre of mass of the bottle being offset from the neck.

In a further aspect, there is a liquid fragrance dispenser comprising a dispensing device and a refill bottle configured to store liquid fragrance; wherein the dispensing device comprises a footprint configured to contact a surface and the dispensing device is asymmetrical with part of the dispenser overhanging the footprint; wherein the bottle comprises a body and neck and the body comprises an asymmetrical bulbous portion; wherein the asymmetrical bulbous portion is located so that a greater proportion of the liquid can be stored in the bottom half of the body than the top half of the body and the centre of mass of the bottle is offset from the neck of the bottle to provide an increased storage volume whilst maintaining the centre of mass within the footprint of the dispenser.

In a further aspect, there is a refill bottle for a liquid fragrance dispensing device, the bottle is configured to be inserted into the fragrance dispenser; the refill bottle comprises a rotatable spray head with a nozzle for dispensing the liquid fragrance, the spray head comprises a rounded part and a nozzle; wherein the spray head is configured to be rotated by the dispensing device so that the nozzle is correctly oriented when the bottle is inserted.

In a further aspect, there is a liquid fragrance dispenser comprising a dispensing device and a refill bottle configured to store liquid fragrance; wherein the refill bottle comprises a rotatable spray head with a nozzle for dispensing the liquid fragrance, the spray head comprises a rounded part and a nozzle; and the dispensing device comprises a jaws configured to receive the spray head; wherein the jaws are configured to contact the rotatable spray head and rotate the spray head so that the nozzle is correctly oriented as the bottle is inserted into the dispensing device.

Aspects of the disclosure are also described in detail, by way of example only, with reference to the accompanying drawings, in which.

Figure 2:
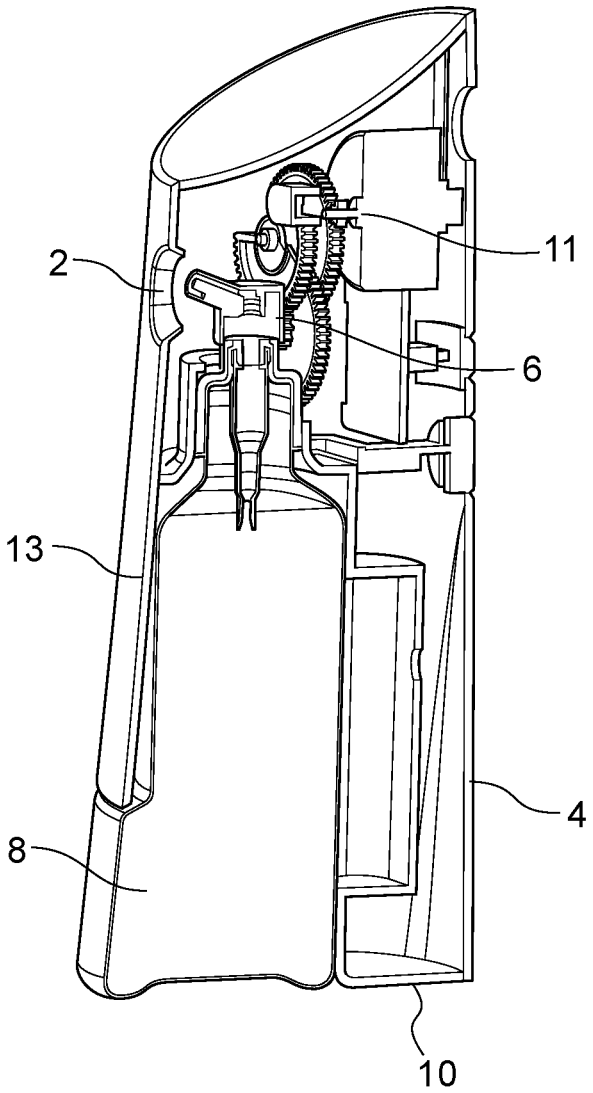
FIG. 2 shows a non-aerosol dispensing device with the refill bottle shown in FIG. 1.
Figure 3A:
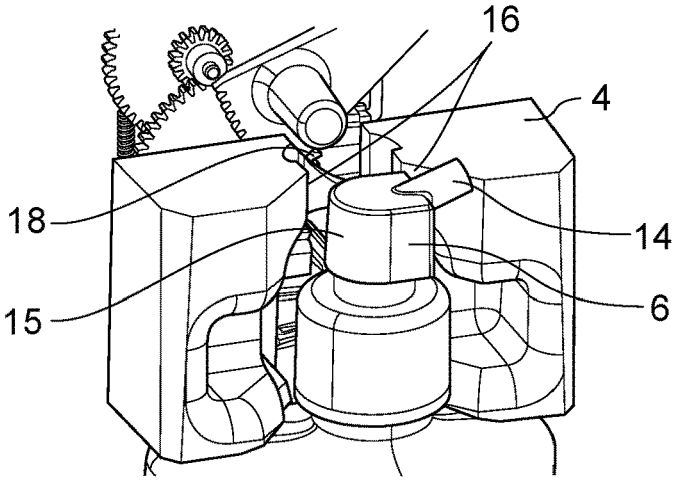
Figure 3B:
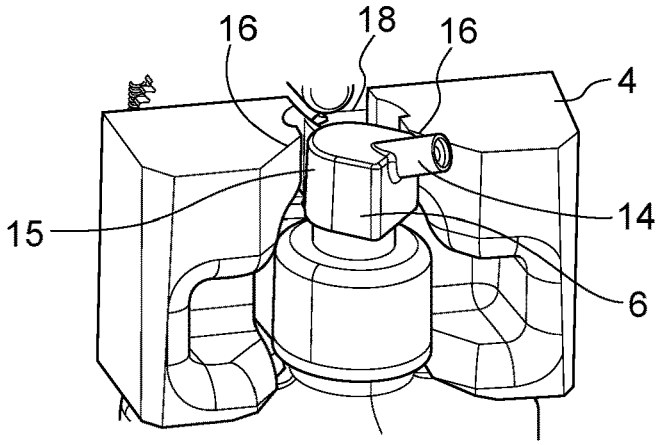
Figure 3C:
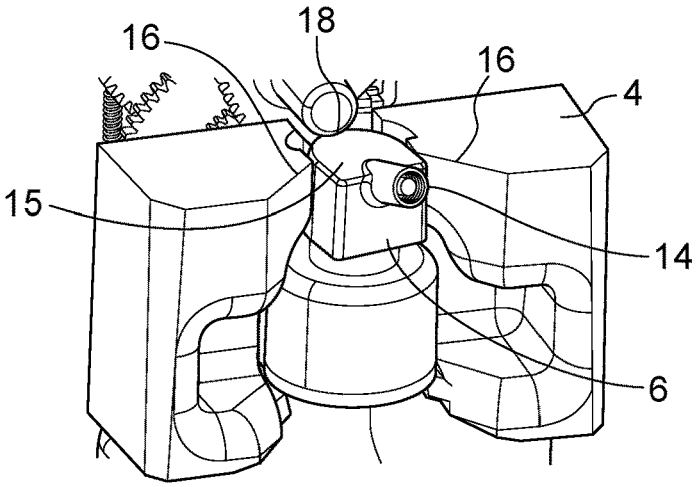

FIG. 3*a* shows the spray head of the bottle in a first position during installation into the device of FIG. 2;

FIG. 3*b* shows the spray head of the bottle in a second position during installation into the device of FIG. 2; and FIG. 3*c* shows the spray head of the bottle in a third position during installation into the device of FIG. 2.

Embodiments will now be described with reference to the Figures.

Figure 1:
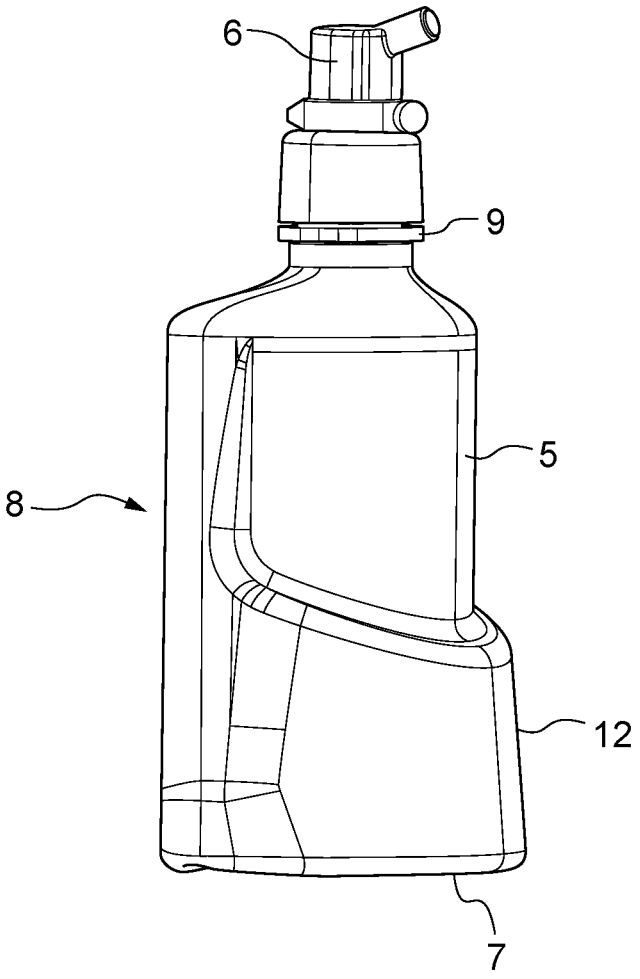
FIG. 1 shows a refill bottle for a non-aerosol dispensing device.

FIG. 1 shows a refill bottle 8 comprising a spray head 6, a neck 9 and a body 5. The body 5 comprises an asymmetrical bulbous portion 12 and a bottom 7.

The refill bottle 8 is configured to hold the fluid for spraying. The fluid is held in a reservoir formed by the body 5 and configured to be dispensed via the spray head 6. In the example illustrated, the spray head 6 is coupled to the body 5 via the neck 9.

The refill bottle 8 is configured to store a greater proportion of the fluid in the bottom half of the body 5 than the top half of the body 5 so that the centre of mass of the bottle 8 is lowered.

The asymmetrical bulbous portion 12 is located so that a greater proportion of the fluid can be stored in the bottom half of the body 5 than the top half of the body 5. In the example illustrated, the asymmetrical bulbous portion 12 is adjacent the bottom 7 of the body 5. The location of the asymmetrical bulbous portion 12 leads to the centre of mass of the body 5 being offset from the neck 9. As discussed in more detail below, the lower centre of mass of the body 5 provides an increase in stability when the refill bottle 8 is used in an asymmetrical dispensing device 4 and an increase in the volume of fluid held by the refill bottle 8.

FIG. 2 shows the refill bottle 8 located in a dispensing device 4. The dispensing device 4 comprises a refill receiving portion 13, a spray orifice 2 and a trigger mechanism 11.

As illustrated in FIG. 2, the refill bottle 8 is configured to be located in the refill receiving portion 13 of the dispensing device 4. When the refill bottle 8 is located in the dispensing device 4 the spray head 6 is configured to align with the spray orifice 2 so that, in use, the spray head 6 dispenses the fluid via the spray orifice 2 when triggered by the trigger mechanism 11.

The dispensing device 4 is configured to be placed on a surface with at least part of the base 10 in contact with the surface. In the example illustrated, the base 10 has three points of contact with the surface. It is advantageous to have three points of contact to the surface to reduce instability of the dispensing device 4 when it is placed on the surface.

The shape of the bottle 8 in the dispensing device 4 reduces the instability associated with the force of trigger mechanism 11 on the refill bottle 8 during dispensing. The shape of the refill bottle 8 leads to a lower centre of mass and therefore increases the stability of the dispensing device 4 when the force is imparted on the trigger mechanism 11.

In the example illustrated, the base 10 contacts a surface and the dispenser is asymmetrical with part of the dispenser overhanging the base. The refill bottle 8 having the asymmetrical bulbous portion 12 is configured to be inserted into dispensing device 4, and the centre of mass of the dispensing device 4 with the refill bottle 8 is located within the base 10 of the dispensing device 4. For example, the centre of mass of the bottle 8 offset from the neck of the bottle 8 to provide an increased storage volume whilst maintaining the centre of mass within the base 10 of the dispenser.

FIGS. 3A, 3B and 3C show the spray head 6 as the refill bottle 8 is docked into the dispensing device 4. The spray head 6 is rotatable and comprises a rounded part 15 and a nozzle 14 for dispensing the fluid. In the example illustrated, the rounded part 15 is located at the opposite side of the spray head 6 relative to the nozzle 14. The dispensing device 4 comprises a mouth having a pair of jaws 16 and a spray head receiving portion 18.

As illustrated in FIGS. 3A, 3B and 3C the jaws 16 are configured to guide the spray head 6 so that the nozzle 14 is correctly oriented with the nozzle 14 directed towards the spray orifice 2 when docked in the spray head receiving portion 18. The jaws 16 cooperate with the rounded part 15 of the spray head 6 so that the nozzle 14 is in the correct orientation. For example, if the spray head 6 is incorrectly oriented one of the jaws 16 will contact the rounded part 15 so that a rotational force is imparted on the spray head 6. The rotational force leads to the spray head 6 rotating so that the nozzle 14 is correctly oriented with the nozzle 14 directed towards the spray orifice 2 when docked in the spray head receiving portion 18.

FIG. 3A shows the spray head 6 entering the jaws 16 with the nozzle 14 incorrectly oriented. FIG. 3B shows the spray head 6 in contact with one of the jaws 16. The contact between the jaw 16 and the spray head 6 rotates the spray head 6 towards the correct orientation. FIG. 3C shows the spray head 6 docked in the spray head 6 receiving portion 18 with the spray head correctly oriented with the nozzle 14 directed towards the spray orifice 2.

The spray head 6 is shaped to contact the jaws 16 if the spray head 6 is in an incorrect orientation. In the example illustrated, the rounded part 15 of the spray head 6 comprises a semi-circular portion with straight portions on either side of the semi-circular portion and the nozzle 14 at the side of the spray head opposite to the semi-circular portion, for example a "D" shape, and the jaws 16 are symmetrical to one another and comprise a straight angled portion. As illustrated in FIGS. 3A, 3B and 3C, the shape of the spray head 6 and the jaws 16 cooperate so that one side of the spray head 6 contacts one of the jaws 16 to rotate the spray head so that the spray head 6 is correctly oriented.

In the examples described above, the refill bottle 8 is configured to hold a fluid. In an example, the fluid is a liquid.

In the examples described above, the spray head comprises a rounded part 15. In other examples, the spray head may comprise two angled parts that meet at a point, for example a triangle. In the example above, the spray head comprises a semi-circular portion with straight portions on either side of the semi-circular portion. The spray head may also comprise pyramidal shape.

Further modifications and developments can be made without departing from the scope of the invention described herein.

The invention claimed is:

1. A refill bottle for a liquid fragrance dispensing device, the bottle configured to be inserted into the fragrance dispensing device;

wherein the bottle comprises a body and a neck, and the body comprises an asymmetrical bulbous portion, wherein the asymmetrical bulbous portion is located so that a greater proportion of the liquid can be stored in the bottom half of the body than in the top half of the body of the refill bottle, wherein the asymmetrical bulbous portion results in the centre of mass of the bottle being offset from the neck, wherein the refill bottle comprises a rotatable spray head with a nozzle for dispensing the liquid fragrance, the spray head comprising a rounded part and a nozzle, and, wherein the spray head is configured to be rotated by the dispensing device so that the nozzle is correctly oriented when the refill bottle is inserted into the dispensing device.

2. The refill bottle of claim 1, wherein the spray head is configured to be rotated by the dispensing device by contacting at least one jaw of the dispensing device as the refill bottle is inserted into the dispensing device.

3. The refill bottle of claim 1, wherein the spray head comprises a semi-circular portion with straight portions on either side of the semi-circular portion and the nozzle is located at the side of the spray head opposite to the semi-circular portion.

4. A liquid fragrance dispenser comprising a dispensing device and a refill bottle configured to store liquid fragrance, wherein the dispensing device comprises a base configured to contact a surface and the dispensing device is asymmetrical with part of the dispenser overhanging the base, wherein the refill bottle comprises a body and a neck, and the body comprises an asymmetrical bulbous portion, wherein the asymmetrical bulbous portion is located so that a greater proportion of the liquid can be stored in the bottom half of the body than in the top half of the body, and the centre of mass of the bottle is offset from the neck of the bottle to provide an increased storage volume whilst maintaining the centre of mass within the base of the dispenser and the base has three points of contact with the surface, the refill bottle comprises a rotatable spray head with a nozzle for dispensing the liquid fragrance, the spray head comprising a rounded part and a nozzle, and, wherein the spray head is configured to be rotated by the dispensing device so that the nozzle is correctly oriented.

5. The liquid dispenser of claim 4, wherein the spray head is configured to be rotated by the dispensing device by contacting at least one jaw of the dispensing device as the bottle is inserted into the dispensing device.

6. The liquid dispenser of claim 4, wherein the spray head comprises a semi-circular portion with straight portions on either side of the semi-circular portion and the nozzle located at the side of the spray head opposite to the semi-circular portion.

7. A refill bottle for a liquid fragrance dispensing device, the refill bottle configured to be inserted into the fragrance dispenser, the refill bottle comprising a body and a neck and the body comprises an asymmetrical bulbous portion, wherein the asymmetrical bulbous portion is located so that a greater proportion of the liquid can be stored in the bottom half of the body than in the top half of the body of the refill bottle, wherein the asymmetrical bulbous portion results in the centre of mass of the bottle being offset from the neck, and wherein:

the refill bottle comprises a rotatable spray head with a nozzle for dispensing the liquid fragrance, the spray head comprising a rounded part and a nozzle;

wherein the spray head is configured to be rotated by the dispensing device so that the nozzle is correctly oriented.

8. The refill bottle of claim 7, wherein the spray head is configured to be rotated by the dispensing device by contacting at least one jaw of the dispensing device as the bottle is inserted into the dispensing device.

9. The refill bottle of claim 7, wherein the spray head comprises a semi-circular portion with straight portions on either side of the semi-circular portion and the nozzle is located at the side of the spray head opposite to the semi-circular portion.

10. A liquid fragrance dispenser comprising a dispensing device and a refill bottle configured to store liquid fragrance, wherein the refill bottle comprises a rotatable spray head with a nozzle for dispensing the liquid fragrance, the spray head comprising a rounded part and a nozzle a body and a neck and the body comprises an asymmetrical bulbous portion;

wherein the asymmetrical bulbous portion is located so that a greater proportion of the liquid can be stored in the bottom half of the body than in the top half of the body of the refill bottle, wherein the asymmetrical bulbous portion results in the centre of mass of the bottle being offset from the neck, and, the dispensing device comprises jaws configured to receive the spray head, wherein the jaws are configured to contact the rotatable spray head and rotate the spray head so that the nozzle is correctly oriented as the bottle is inserted into the dispensing device.

11. The dispenser of claim 10, wherein the spray head is configured to be rotated by the dispensing device by contacting at least one jaw of the dispensing device as the bottle is inserted into the dispensing device.

12. The dispenser of claim 10, wherein the spray head comprises a semi-circular portion with straight portions on either side of the semi-circular portion and the nozzle is located at the side of the spray head opposite to the semi-circular portion.

13. The dispenser of claim 10, wherein the jaws are symmetrical to one another and comprise a straight angled portion.

* * * * *